United States Patent [19]

Roche

[11] Patent Number: 4,626,135

[45] Date of Patent: Dec. 2, 1986

[54] MARINE RISER WELL CONTROL METHOD AND APPARATUS

[75] Inventor: Joseph R. Roche, Humble, Tex.

[73] Assignee: Hydril Company, Los Angeles, Calif.

[21] Appl. No.: 663,235

[22] Filed: Oct. 22, 1984

[51] Int. Cl.[4] ..... E21B 33/06

[52] U.S. Cl. ..... 405/195; 166/84

[58] Field of Search ..... 405/195, 169, 170, 171; 166/85, 87, 350, 359, 367; 114/264, 265; 285/16

[56] References Cited

U.S. PATENT DOCUMENTS

| | | | |
|---|---|---|---|
| 1,237,381 | 8/1917 | Poppenhusen et al. | 285/16 |
| 1,289,154 | 12/1918 | Girtanner et al. | 285/16 X |
| 1,357,259 | 11/1920 | Strong | 285/16 |
| 2,911,235 | 11/1959 | Stumbough | 285/16 X |
| 3,791,442 | 2/1974 | Watkins | 166/352 |
| 4,444,250 | 4/1984 | Keithahn et al. | 166/84 |
| 4,456,062 | 6/1984 | Roche et al. | 166/84 |
| 4,456,063 | 6/1984 | Roche | 166/84 |

OTHER PUBLICATIONS

Riser Collapse–A Unique Problem in Deep-Water Drilling, by P. R. Erb et al, Conoco Inc., 1983, IADC/SPE, 1983 Drilling Conference.

*Primary Examiner*—Dennis L. Taylor

*Attorney, Agent, or Firm*—Dodge, Bush & Moseley

[57] ABSTRACT

This invention provides a method and apparatus for maintaining safe pressure in the annulus of a deepwater marine riser by preventing the displacement of drilling mud with formation gas. By providing an improved flow diverting control device having an annular sealing device in the riser string below the riser telescopic joint, liquid well fluids under limited pressure can be maintained in the riser despite the impetus of formation gas below the mud column to displace the liquid. Provision of the annular shut-off below the telescopic joint eliminates the necessity to seal well fluid pressure at the telescopic joint packer during kick control circulating operations. The flow diverting control device includes an outlet which opens on the closing of the annular sealing device and which provides a flow path beneath the annular sealing device to a choke line to facilitate bringing the well under control by circulating kill mud. If the BOP stack is on bottom, circulation can be directed down a riser kill line and introduced into the annulus above a closed ram. If the BOP's are open or if the stack is not on bottom, circulation is directed down the drill pipe, up the riser annulus and through the choke manifold. By maintaining a mud column in the riser annulus, the hazard of collapsing the pipe by external hydrostatic head near the lower end of a deepwater marine riser is avoided.

6 Claims, 3 Drawing Figures

FIG. 1
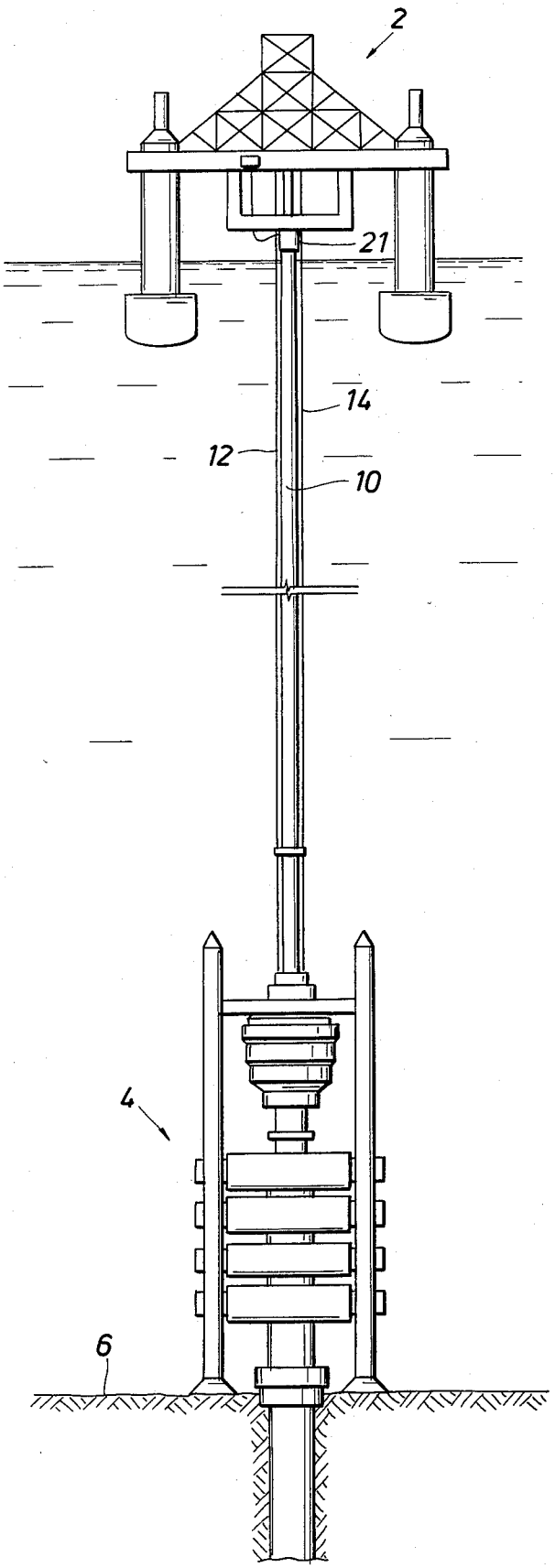
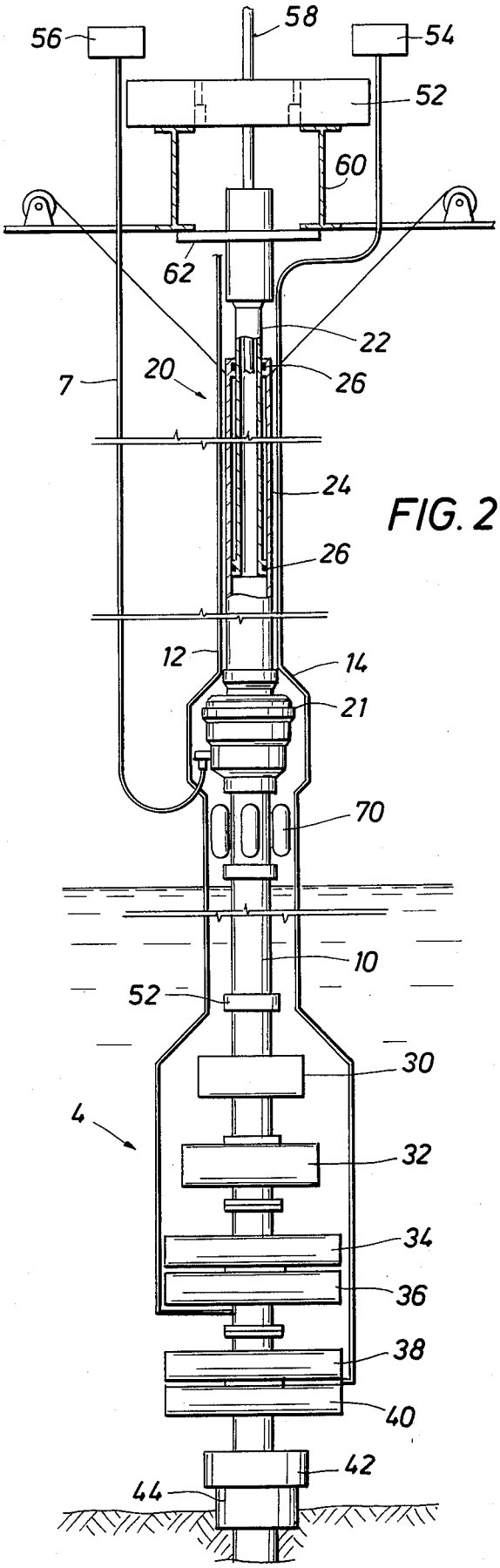
FIG. 2

MARINE RISER WELL CONTROL METHOD AND APPARATUS

BACKGROUND OF THE INVENTION

1. Field of the Invention

This invention relates generally to marine drilling apparatus and methods for deep water operations. Specifically the invention relates to a method and apparatus for preventing the displacement of drilling mud by formation gas in the drilling riser thereby preventing the collapse of the riser due to the external pressure of the seawater.

2. Description of the Prior Art

The oil industry has had great success in pushing back the water depth frontiers for exploratory drilling offshore. Many technical challenges have been successfully met in the course of this effort. Two areas that are particularly noteworthy in this respect are the extension of the capability of marine risers and the development of new well control techniques. However, the problem of hydrostatic collapse of a marine riser in deep water has remained unsolved in this emerging technology.

On occasion a deepwater marine riser has collapsed at its lower segments. When the mud column in the riser annulus about a drill pipe has been displaced by formation gas, the resulting low pressure in the riser annulus has rendered the pressure differential ($\Delta P$) across the pipe wall so great that the collapse strength of the pipe has been exceeded. To combat such an occurrence, some deepwater risers have been equipped with riser fill valves which are intended to open the riser annulus to seawater influx before critical $\Delta P$ has been reached. Typically, such valves are fitted with controls that sense $\Delta P$ changes and automatically open the valve. A manual override is usually provided. Because of the unpredictability of the formation pressures such inflexible means of controls have been uncertain and risky. At best, such apparatus provides only one opportunity to restore equilibrium with critical dependence on the density of seawater. If the kinetic energy of the flowing fluid is sufficiently high, entering seawater may be ejected from the top of the riser.

3. Identification of Objects of the Invention

It is therefore an object of the invention to provide a well control system and apparatus to control the well when formation gas displaces drilling mud in a deepwater riser.

It is another object of the invention to provide a marine riser well control apparatus and method whereby formation gas which displaces drilling fluid in a deepwater riser may be circulated out via the drilling rig choke manifold while maintaining pressure of control over the well and the deepwater riser.

SUMMARY OF THE INVENTION

The above identified objects of the invention as well as other advantages and features are accomplished by providing a marine riser well control system and method for its operation for deep water drilling operations. The system includes a telescopic joint connected to a floating vessel drilling rig below which is connected a riser control device having a housing with a vertical bore through it and at least one outlet passage provided in its wall. The bore of the housing is in fluid communication with the telescopic joint to which it is connected. A packing element is disposed within the housing as well as an annular piston beneath the packing element which is adapted for moving from a lower position to an upper position within the housing.

The wall of the piston in the lower position covers the outlet passage in the housing wall and prevents fluid communication from the bore of the housing to the outlet passage. In the upper position, the wall of the annular piston at least partially uncoveres the outlet passage and allows fluid communication from the bore of the housing to the outlet passage as the piston urges the packing element to close about an object extending through the bore of the housing.

A blowout preventer stack having at least one ram blowout preventer is connected to the wellhead of the borehole on the seabed. A riser string is disposed between the blowout preventer stack and the riser control device. An auxiliary choke line is connected between the outlet passage of the housing of the riser control device and a choke manifold of the drilling rig. A kill line is connected between the drilling rig mud pumps of the drilling rig and an outlet in the blowout preventer stack above the ram blowout preventer.

The method of using the well control system described above when formation gas rises above the blowout preventer, is to first close the ram blowout preventer, about the drill pipe which extends through it. The piston of the riser control device is then operably moved to the upper position to close the packing element about the drill pipe extending through its bore while opening the outlet passage in its housing wall to the annulus of the riser control device about the drill pipe. Drilling mud is then applied from the drilling rig mud pumps via the kill line to the annulus of the blowout preventer stack for circulating the formation gas out of the riser via the riser control device outlet passage, said auxiliary choke line, and said choke manifold.

If the blowout preventers are open, or if they are not yet provided on the seabottom, circulation is directed down the drill pipe, up the riser annulus and through the choke manifold via the outlet passage in the riser control device after the annular packing element closes about the drill pipe extending through its bore. By maintaining a mud column in the riser annulus, the hazard of collapsing the pipe by external hydrostatic pressure near the lower end of the deepwater marine riser is avoided.

The control device used in the marine riser well control system includes an improvement whereby a connector is attached to the housing about the outlet passage in the wall of the diverter housing. The connector has a passage defining a ninety-degree turn which has a lead target disposed therein for resisting erosion of pressurized well fluid out of the housing passage.

BRIEF DESCRIPTION OF THE DRAWINGS

The objects, advantages and features of the invention will become more apparent by reference to the drawings which are appended hereto and wherein like numerals indicate like parts and wherein an illustrative embodiment of the invention is shown of which:

FIG. 1 schematically illustrates a deepwater drilling system having a blowout preventer stack disposed on the sea floor and a drilling rig vessel connected thereto by means of a riser system;

FIG. 2 illustrates schematically and partially in cross-section in more detail the marine riser well control apparatus provided according to the invention.

DESCRIPTION OF THE INVENTION

Figure 3:
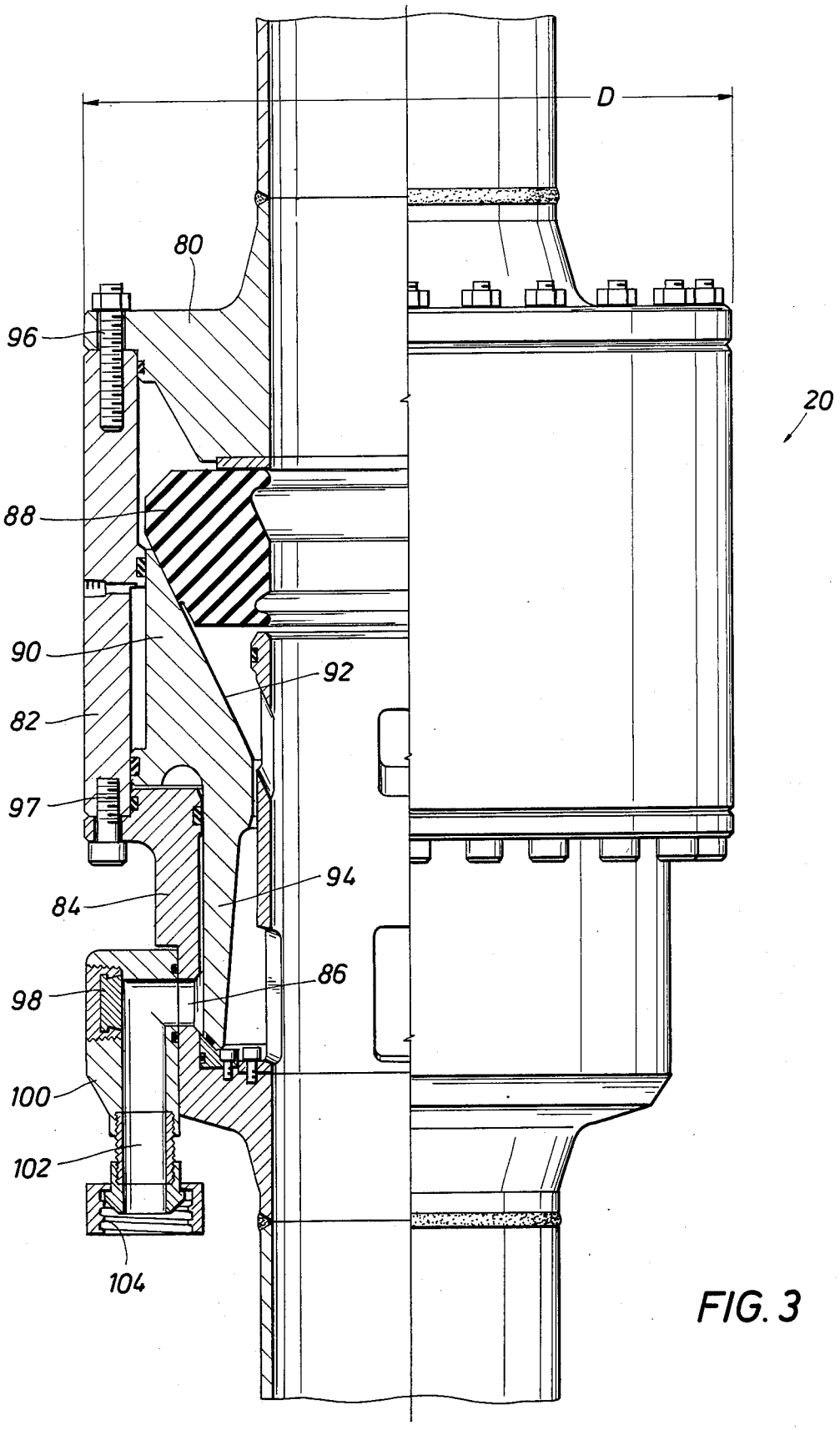
FIG. 3 illustrates an improved riser control device adapted for riser pressure control and used in the marine riser well control apparatus and method of FIG. 2.

FIG. 1 illustrates the environment in which this invention is used. A floating drilling vessel 2 is provided for drilling a borehole B through the seabed 6 beneath water surface 8. A blowout preventer stack 4 is disposed on the seafloor above a wellhead 44. A riser 10 and choke and kill lines 12, 14 are provided for well control between the floating vessel 2 and the blowout preventer stack 4. A flow riser control device 20 is provided beneath the rig floor and the telescopic joint 21.

FIG. 2 illustrates in more detail the marine riser well control apparatus according to the invention. The rotary table 52 is illustrated in drilling floor 53. Beams 60 beneath the drilling floor are attached to a support 62 for supporting a flex joint 63 connected to the inner barrel 22 of telescopic joint 21. A riser control device 20 according to the invention is connected to the outer barrel 24 of the telescopic joint 21. Packing 26 between inner barrel 22 and the outer barrel 24 of the telescopic joint 21 allows the inner barrel 22 to move up and down within the outer barrel 24 due to the heave of the floating drilling vessel 2 while drilling mud is normally passing through it to return to the mud pumps.

The riser control device 20 to be described in detail below with respect to FIG. 3 includes an L shaped connector 100 to an outlet in the riser control device housing wall. An auxiliary choke line 7 is connected between the outlet connector 100 and a choke manifold 56 of the floating drilling vessel 2.

A riser string 10 is connected to the bottom of the flow controller 20. The riser string extends in some cases thousands of feet deep below the water surface to a blowout preventer stack 4 attached to a wellhead 44 of the well being drilled. The blowout preventer stack 4 provided for marine drilling typically includes four pipe rams and an annular blowout preventer as illustrated in FIG. 2. Ram pipe blowout preventers 40, 38, 34 and 36 are provided along with a shear ram blowout preventer 32. An annular blowout preventer is illustrated schematically as element 30. Hydraulic connectors 51 and 42 connect the connecting spools of the stack to the wellhead 44 and to the drilling riser 10 respectively.

Choke line 12 may be connected as illustrated in blowout preventer stack 4 and extends to the surface choke manifold 56 (although for simplicity not illustrated). Kill line 14 is illustrated as extending downwardly along the telescopic joint and the riser 10 and is connected to the spool to the blowout preventer spool above the lower ram blowout preventer 40. The kill line 14 is connected to the mud pumps 54 for providing pressurized drilling fluid to the blowout preventer stack above the ram blowout preventer 40. A length of drill pipe 58 is illustrated as extending down through the telescopic joint 21, the riser control device 20 and the riser 10 and the blowout preventer stack 4 and into the borehole below for drilling the borehole. As illustrated in FIG. 2 the marine riser string 10 as well as the riser control device 20 and the telescopic joint 21 may be run through the rotary table for ease of installation.

FIG. 3 illustrates the construction details of the improved riser control device or diverter 20 of the marine riser well control apparatus according to the invention. The riser control device 20 includes a cylindrical housing or outer body 82 with a lower body 84 and an upper head 80 connected to the outer body 82 by means of bolts 97 and 96. Disposed within the housing 82 is an annular packing unit 88 and a piston 90 having a conical bowl shape 92 for urging the annular packing unit 88 radially inwardly upon the upward movement of piston 90. The lower wall 94 of piston 90 covers an outlet passage 86 in the lower body 84 when the piston is in the lower position. When the piston moves upwardly to force the packing element 88 inwardly about a drill pipe extending through the bore of the diverter 20, the lower end of the piston 94 moves upwardly and opens the outlet passage 86.

A connector 100 has a ninety-degree turn passage 102 which communicates with the outlet passage 86. A lead "target" plate 98 is provided in line with the outlet 86 to withstand the pressurized fluid flow which may flow out of outlet 86. When the piston lower wall 94 is moved upwardly lead plate 98 withstands the highly erosive effect of the pressurized mud flow. A threaded connection 104 is provided to connect the auxiliary choke line 7 extending upwardly as illustrated in FIG. 2 to the choke manifold 56.

The outer dimension D as illustrated in FIG. 3 of the housing 82 of the riser control device 20 is provided to be less than the outer dimension of the removeable inserts of the rotary table 52. The L shaped connector 100 is also designed to insure that the outer dimension of the entire riser control assembly 20 may be run through the rotary table for ease of installation. As illustrated in FIG. 2, accumulator bottles 70 may be attached directly to the drilling riser string beneath the flow diverter 20 to provide rapid hydraulic operation of the piston 90 of the riser control device 20 during an emergency kick of formation gas into the riser string.

Operation of the Invention

FIG. 2 serves to illustrate the operation of the marine riser well control apparatus according to the invention. In the event of excessive formation gas flow, the upward flow path of the riser annulus is closed by actuating the riser control device. Actuation of the riser control device 20 causes the piston 90 to move upwardly thereby causing the packing element 88 to move radially inwardly to seal about a drill pipe 58 through its vertical flow path. As the piston 90 moves up, the outlet 86 is uncovered by the lower portion or wall 94 of the piston 90. Rapid closing may be assured by the use of large multiple hydraulic control lines and a bank of dedicated accumulator bottles 70 which are remotely rechargeable and manifolded together and mounted on the riser string 10. Preferably, the riser control device 20 is designed for two thousand PSI working pressure compatible with the riser string pressure rating and anticipated formation pressures. Having safely closed the annulus and having opened the auxiliary choke line 7 via riser control device outlet 86, the bottom most ram blowout preventer 40 is closed and pressurized drilling mud from pumps 54 is applied via kill line 14 to the annulus of the stack above the ram blowout preventer 40.

The kill mud is then pumped into the annulus between the interior of the riser string 10 and the exterior of the drill pipe 58. The drilling mud provides return flow circulation through the choke manifold until a normal well pressure is restored. By rapidly providing drilling mud into the annulus of the riser string 10 sufficient working pressure is maintained within its interior so that the pressure external to the riser string 10 from deep seawater will not collapse the drilling riser 10. Following kill operations, the annular packer 88 of the flow diverter 20 can be opened and the auxiliary choke line 7 shut off and routine drilling operations resumed.

Where the blowout preventer stack 4 is not provided to the wellhead 44 but the drilling riser 10 is connected directly thereto, the kill line 14 of course is not provided but control over pressure in the deepwater riser string 10 is provided by pumping drilling mud through the interior of the drill pipe 58. The mud is pumped out the end of the drill pipe in the borehole and returns to the annulus of the drill string 10, where upon operation of the riser control device 20 as described above, the formation gas in the drill string 10 may be circulated out via the auxiliary choke line 7 to the choke manifold 56. Again, following kill operations, the annular packer 88 of the riser control device 20 may be opened and the choke line shut off and routine drilling operations resumed.

Various modifications and alterations in the described structures and methods will be apparent to those skilled in the art of the foregoing description which does not depart from the spirit of the invention. For this reason, these changes are desired to be included in the appended claims. The appended claims recite the only limitations to the present invention in the descriptive manner which is employed for setting forth the embodiments and is to be interpreted as illustrative and not limitative.

What is claimed is:

1. An improved flow diverter having an outer dimension adapted for riser pressure control, the flow diverter having a housing having a bore therethrough and at least one outlet passage having an axis provided in its wall, a packing element disposed within the housing, an annular piston disposed within the housing beneath the packing element and adapted for moving from a lower position to an upper position within the housing, the wall of said annular piston in said lower position covering said outlet passage in the housing wall and preventing fluid communication from the bore of the housing to the outlet passage, and in the upper position, the wall of the annular piston at least partially uncovering said outlet passage and allowing fluid communication from the bore of the housing to the outlet passage as the piston urges said packing element to close about an object extending through the bore of the housing, wherein the improvement comprises, a connector having a passage defining a ninety-degree turn, one end of said connector attached to said housing about said outlet passage in the wall of said diverter housing so that said connector is disposed within the outer dimension of the flow diverter, said ninety-degree turn passage having a target means disposed therein substantially perpendicularly to the axis of said outlet passage for resisting erosion of pressurized well fluid out of said housing passage, and means for connecting an auxiliary choke line to the other end of said connector.

2. The improved flow diverter of claim 1 wherein said target means is a lead plate at said ninety-degree turn in said connector disposed opposite said housing outlet passage.

3. A marine riser well control system comprising a telescopic joint connected to a floating vessel drilling rig, said drilling rig having a choke manifold and mud pumps, a riser control device connected below said telescopic joint and having, a housing having a bore therethrough and at least one outlet passage provided in its wall, a packing element disposed within the housing, an annular piston element disposed within the housing beneath the packing element and adapted for moving from a lower position to an upper position within the housing, the wall of said annular piston in said lower position covering said outlet passage in the housing wall and preventing fluid communication from the bore of the housing to the outlet passage, and in the upper position, the wall of the annular piston at least partially uncovering said outlet passage and allowing fluid communication from the bore of the housing to the outlet passage as the piston urges said packing element to close about an object extending through the bore of the housing, a blowout preventer stack having at least one ram BOP, said stack connected to the wellhead of a borehole on the seabed, a riser string disposed between said blowout preventer stack and said riser control device, an auxiliary choke line connected between said outlet passage of said riser control device housing and a choke manifold of said drilling rig, and a kill line connected between said drilling rig mud pumps of said drilling rig and an outlet in said blowout preventer stack above said ram BOP, whereby, in the event of formation gas rising above said ram BOP, said ram BOP may be operably closed about a drill pipe extending through it, said piston of said riser control device may be operably moved to said upper position for closing the packing element about said drill pipe while opening said outlet passage to the annulus of said device around said drill pipe, and drilling mud may be operably applied from said drilling rig mud pump to the annulus of said blowout preventer stack for circulating said formation gas out of the riser via said outlet passage, said auxiliary choke line and said choke manifold.

4. A marine riser well control system comprising, a telescopic joint connected to a floating vessel drilling rig, said drilling rig having a choke manifold and mud pumps, a riser control device connected below said telescopic joint having, a housing having a bore therethrough and at least one outlet passage provided in its wall, a packing element disposed within the housing, an annular piston element disposed within the housing beneath the packing element and adapted for moving from a lower position to an upper position within the housing, the wall of said annular piston in said lower position covering said outlet passage in the housing wall and preventing fluid communication from the bore of the housing to the outlet passage, and in the upper position, the wall of the annular piston at least partially uncovering said outlet passage and allowing fluid communication from the bore of the housing to the outlet passage as the piston urges said packing element to close about an object extending through the bore of the housing, a riser string connected between a wellhead of a borehole on the seabed and said riser control device, and an auxiliary choke line connected between said outlet passage of said riser control device housing and a choke manifold of said drilling rig, whereby in the event of formation gas rising in said riser string, said piston of said riser control device may be operably moved to said upper position thereby operably closing the packing element about a drill pipe while opening said outlet passage to the annulus of said device around said drill pipe, and drilling mud may be operably applied via the inside of said drill pipe and then up the annulus between the exterior of the drill pipe and the interior of the riser for circulating said formation gas out of the riser via said outlet passage, said auxiliary choke line and said choke manifold.

5. A method for maintaining safe pressure in the annulus of a marine drilling riser, said riser being a part of a marine riser well control system having, a telescopic joint connected to a floating vessel drilling rig, said drilling rig having a choke manifold and mud pumps, a riser control device connected below said telescopic joint having, a housing having a bore therethrough and at least one outlet passage provided in its wall, a packing element disposed within the housing, an annular piston element disposed within the housing beneath the packing element and adapted for moving from a lower position to an upper position within the housing, the wall of said annular piston in said lower position covering said outlet passage in the housing wall and preventing fluid communication from the bore of the housing to the outlet passage, and in the upper position, the wall of the annular piston at least partially uncovering said outlet passage and allowing fluid communication from the bore of the housing to the outlet passage as the piston urges said packing element to close about an object extending through the bore of the housing, a blowout preventer stack having at least one ram BOP, said stack connected to the wellhead of a borehole on the seabed, a riser string disposed between said blowout preventer stack and said riser control device, an auxiliary choke line connected between said outlet passage of said riser control device housing and a choke manifold of said drilling rig, and a kill line connected between drilling rig mud pumps of said drilling rig and an outlet in said blowout preventer stack above said ram BOP, the method of controlling formation gas rising above said ram BOP comprising the steps of, closing said ram BOP about a drill pipe extending through the riser and into the borehole, causing said piston of said riser control device to be moved to said upper position operably closing said packing element about a drill pipe extending through it while opening said outlet passage to the annulus of said device around said drill pipe, applying drilling mud from said drilling rig mud pumps via said kill line to the annulus of said blowout preventer stack and said marine riser while circulating said formation gas out of the riser via said outlet passage, said auxiliary choke line and said choke manifold.

6. A method for maintaining safe pressure in the annulus of a marine drilling riser, said riser being a part of a marine riser well control system having a telescopic joint connected to a floating vessel drilling rig, said drilling rig having a choke manifold and mud pumps, a riser control device connected below said telescopic joint having, a housing having a bore therethrough and at least one outlet passage provided in its wall, a packing element disposed within the housing, an annular piston element disposed within the housing beneath the packing element and adapted for moving from a lower position to an upper position within the housing, the wall of said annular piston in said lower position covering said outlet passage in the housing wall and preventing fluid communication from the bore of the housing to the outlet passage, and in the upper position, the wall of the annular piston at least partially uncovering said outlet passage and allowing fluid communication from the bore of the housing to the outlet passage as the piston urges said packing element to close about an object extending through the bore of the housing, a riser string connected between a wellhead on the seabed and said riser control device, and an auxiliary choke line connected between said outlet passage of said riser control device housing and a choke manifold of said drilling rig, the method of controlling formation gas rising into said riser string comprising the steps of, causing said piston of said riser control device to be moved to said upper position operably closing the packing element about a drill pipe extending through it while opening said outlet passage to the annulus of said device around said drill pipe, and pumping drilling mud via the interior of said drill pipe and then up the annulus between the exterior of the drill pipe and the interior of the riser for circulating said formation gas out of the riser via said outlet passage, said auxiliary choke line and said choke manifold.

* * * * *